United States Patent [19]

Aliberti et al.

[11] Patent Number: 5,070,544

[45] Date of Patent: Dec. 10, 1991

[54] GARMENT ACCESSORY

[76] Inventors: Mimma D. Aliberti, 144 Murray Ave., Yonkers, N.Y. 10704; Enza Lombardo; Piera Lombardo, both of 253 Ackertown Rd., Chestnut Ridge, N.Y. 10952

[21] Appl. No.: 609,447

[22] Filed: Nov. 5, 1990

[51] Int. Cl.[5] ..... A41B 7/00

[52] U.S. Cl. ..... 2/170; 2/124; 2/232

[58] Field of Search ..... 2/59, 170, 124, 60, 2/16, 61, 123, 126, 125, 232

[56] References Cited

U.S. PATENT DOCUMENTS

| | | | |
|---|---|---|---|
| 293,500 | 2/1884 | Northrup | 2/170 |
| 699,802 | 5/1902 | Mendelsohn | 2/170 |
| 858,845 | 7/1907 | Würtemberg | 2/124 |
| 1,302,038 | 4/1919 | Hayes | 2/59 |
| 1,312,100 | 8/1919 | Clothier | 2/124 |
| 1,314,326 | 8/1919 | Heeren | 2/124 |
| 1,391,094 | 9/1921 | Brach | 2/124 |
| 1,413,897 | 4/1922 | Calco | 2/124 |
| 1,448,455 | 3/1923 | Leander | 2/232 |
| 1,484,187 | 2/1924 | O'Neill et al. | 2/60 |
| 2,066,975 | 1/1937 | Holdren | 2/232 |
| 2,677,829 | 5/1954 | Rothstein et al. | 2/232 |
| 2,822,596 | 2/1958 | Aaskov | 2/232 |
| 3,594,819 | 7/1971 | Mullins | 2/170 |
| 3,849,804 | 11/1974 | Rakow | 2/232 |
| 4,984,299 | 1/1991 | Halldorsdottir | 2/59 |

*Primary Examiner*—Werner H. Schroeder
*Assistant Examiner*—Amy Brooke Vanatta
*Attorney, Agent, or Firm*—Lackenbach Siegel Marzullo & Aronson

[57] ABSTRACT

A garment accessory for application to an arm of a human being is used in combination with a garment having at least one sleeve. The garment accessory includes a cuff and a gripping portion. The cuff is provided with a decorative inner surface and an outer surface. The garment accessory is mounted on the arm and being movable from a first to a second position. In the first position, the gripping portion engages a forearm of the user, so that the cuff is positioned adjacent to a wrist of the user. In the second position, at least an end portion of the cuff is turned inside out in such a manner that the decorative inner surface of the cuff extends over the sleeve, thereby creating a decorative effect.

20 Claims, 5 Drawing Sheets

FIG. 1
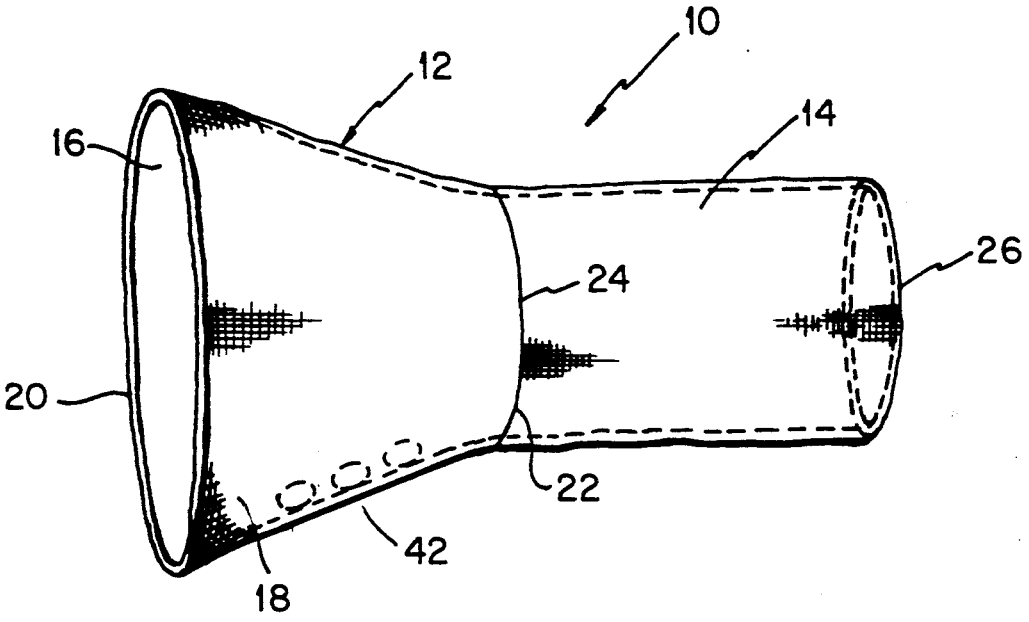
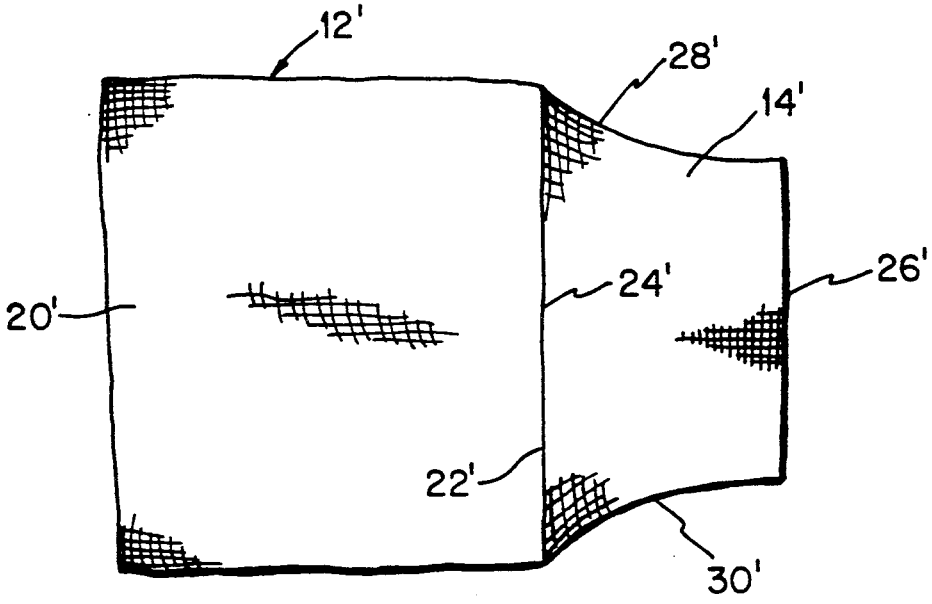
FIG. 2

GARMENT ACCESSORY

BACKGROUND OF THE INVENTION

This invention relates to garment accessories and more particularly, to reversible decorative sleeves, legs of trousers, cuffs and the like.

More specifically, it has become fashionable to "decorate" the ends of sleeves of jackets and other garments by a material other than that from which an exterior of the garment is made. This is typically accomplished by turning a sleeve of a garment inside out for a predetermined length so as to create a decorative effect at the end of the sleeve by exposing a lining of the garment to the eyes of an observer. The lining is typically permanently attached to the sleeve and therefore, only one decorative combination can be created when the sleeve is turned inside out and the lining is exposed. In some situations, in order to reduce the cost of manufacturing in the highly competitive market, some garments are produced with sleeves whose undersides have no lining. Furthermore, after some use of a garment, its lining in general and at the ends of the sleeves in particular, evidence considerable wear and tear. These disadvantages prevent wearers from turning over their sleeves for fear of showing that their garment is inexpensive and has no lining or that their garment lining is worn out and/or torn.

All of the above clearly illustrate the need for a garment accessory which enables a user to replace and/or substitute at least a part of a lining which is positioned at an end of trouser cuffs or sleeves of a garment and used for decorative purposes.

U.S. Pat. No. 3,594,819 to Robert Guy Mullins discloses a sleevelet which can be worn as a false cuff together with a short-sleeve shirt. The sleevelet extends from a sleeve of a garment in order to give an appearance that the user is wearing a long-sleeve shirt. Mullins does not teach a garment accessory which can be turned over in such a manner that an interior of the accessory is placed over an exterior of a sleeve of a garment for decorative purposes.

U.S. Pat. No. 1,544,115 to C. M. Flora provides a folding reversible French cuff. Even though, the cuff of the Flora patent is in some way replaceable, it is not designed to be used in combination with a sleeve of a garment. This patent does not disclose that such French cuff can be turned and placed over an exterior part of a sleeve of a garment in order to create a decorative effect.

SUMMARY OF THE INVENTION

The present invention provides a garment accessory for use in combination with a garment having at least one sleeve means. The garment accessory consists of cuff means and gripping means, the cuff means has an inner decorative surface and an outer surface. In use, the garment accessory is movable from a first to a second position. In the first position, the gripping means engages a forearm of a user so that the cuff means is positioned adjacent to a wrist of the user. In the second position, the garment accessory is turned over inside out in such a manner that said inner decorative surface of the cuff means extends over the sleeve and is exposed to the eyes of an observer creating a decorative effect.

In another embodiment of the invention, the sleeve means of the garment is defined by at least an exterior portion thereof and in the second position of the accessory, the exterior portion of the sleeve means faces the outer surface of the cuff means.

In a further embodiment of the invention, an interconnecting means is provided for interconnecting the cuff and gripping means.

BRIEF DESCRIPTION OF THE DRAWINGS

Other advantages and features of the invention are described with reference to exemplary embodiments, which are intended to explain and not to limit the invention, and are illustrated in the drawings in which:

FIG. 1 is a side view of a garment accessory according to the present invention in its initial, unfolded condition;

FIG. 2 is a side elevational view of another embodiment of the garment accessory in the initial, unfolded condition;

DESCRIPTION OF ILLUSTRATIVE EMBODIMENT

Although a specific embodiment of the invention will now be described with reference to the drawings, it should be understood that the embodiment shown is by way of example only and merely illustrative of but one of the many possible specific embodiments which can represent applications of the principles of the invention. Various changes and modifications, obvious to one skilled in the art to which the invention pertains, are deemed to be within the spirit, scope and contemplation of the invention as further defined in the appended claims.

Figure 3:
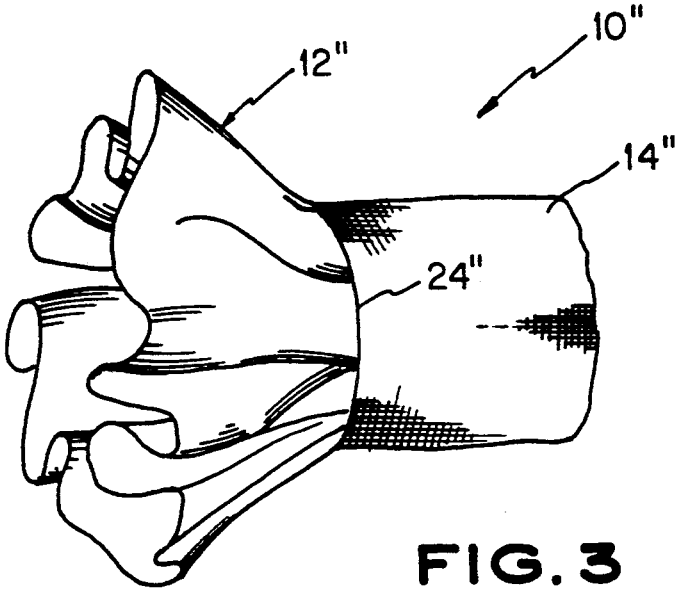
FIG. 3 is a side elevational view of a further embodiment of the garment accessory.

Referring now to the drawings in general and to FIGS. 1 and 2 in particular where an illustrative embodiment of a garment accessory according to the present invention, is depicted. FIG. 1 illustrates the garment accessory 10 which generally comprises a cuff or cuff means 12 and a gripping portion or gripping means 14. The cuff comprises an inner surface or part 16, outer surface or part 18, a front edge 20 and a rear edge 22. The gripping portion 14 is suitably designed in the form of a tubular, sleeve-type elongated member having a front edge 24 and a rear edge 26. In the embodiment of FIGS. 1–3, the cuff and gripping portion are shown to be connected to each other without any intermediary member. Therefore, the rear edge of the cuff and the front edge of the sleeve appear as being the same. However, other embodiments of the invention in which an intermediary, connecting portion is positioned between the cuff and the gripping portion are within the scope of the invention and will be discussed hereinbelow in the application. The edges 24 and 26 of the gripping portion are shown in FIG. 1 to be positioned in substantially parallel planes, but other configurations of these edges is also contemplated, such as angled planes in the same or opposite directions.

In order to form the garment accessory, as shown in FIG. 1, the front edge 24 of the gripping portion is connected to the rear edge of the cuff 22 by securing means, such as stitching, but means other than stitching can also be employed. For example, snaps, adhesives, buttons, zippers, and the like.

The cuff could be manufactured from a single layer or two individual layers of fabric. In the event that the cuff is made from a single layer of fabric and such fabric has two sides, one of which is produced with a better quality of surfacing and/or better quality imprint, then in manufacture of the cuff the fabric should be positioned in such a wa that the better side of the fabric defines the inner surface 16 of the cuff. The side of the fabric of the lower quality should face the exterior and define the outer surface 18 of the cuff. This is necessary in order to expose the better quality surface of the fabrics to the eyes of an observer when the cuff in the working condition with the garment accessory is turned over or inside out.

When the cuff 12 is made of two layers of fabric, in order to reduce the cost of manufacturing, it is recommended to use a less expensive fabric to manufacture the outer part and more expensive fabric having its better quality imprint facing the interior of the accessory for manufacturing of the inner surface of the cuff. The inner surface of the cuff can be manufactured from silk, polyester, cotton, leather and any other suitable material.

Since the main function of the gripping portion 14 is to position the garment accessory on the forearm of the user with a certain degree of stability, it is preferred to use for its manufacture, any type of material or fabric which is flexible and/or porous which fits snugly around the arm. For example, stretch lace, stretch cotton or stretch synthetic fabrics, etc. could be used for this purpose. In use the gripping portion is initially positioned within the area of a forearm between the wrist and elbow and could be of any suitable length. In some accessories, the gripping portion may extend above the elbow.

The gripping portion is preferably made of a elastic material which permits this portion of the garment accessory to be stretched so as to accommodate and conform to forearms of varying sizes and to grip snugly thereabout. The elastic gripping means 14 engages the user's forearm to permit the user to thereby specifically position the cuff 12 about the forearm and adjacent to his or her wrist. The elastic gripping means enables easy removal of the garment accessory, and furthermore it is comfortable to the wearer when the garment accessory is worn for a relatively long time, and it freely yields to accommodate the various movements and/or requirements imposed by the user.

Alternatively, the snug fit of the gripping portion around the arm can be provided by other conventional securing means, such as buttons, zippers, garter-like elastic straps, VELCRO, and the like.

In the embodiment of FIG. 1, the gripping portion 14 is shown having a substantially tubular shape in which edges 24 and 26 are of approximately the same diameter. The cuff 12 of this embodiment is designed with a funnel-type or frusto-conical configuration, so that the rear edge 22 is shorter in its axial length than the front edge 20.

In the embodiment of FIG. 2, a gripping portion 14' is designed as a frusto-conical member having concave side edges 28' and 30'. In this embodiment, the cuff 12' is defined as a substantially cylindrical member with front and rear edges 20' and 22' having substantially the same length in the radial direction thereof.

According to a further embodiment of the invention as illustrated in FIG. 3 the cuff 12 is gathered along the front edge 24 of the gripping portion 14 to impart a ruffled configuration of the cuff. A dressier appearance is achieved with this variant embodiment.

Figure 4:
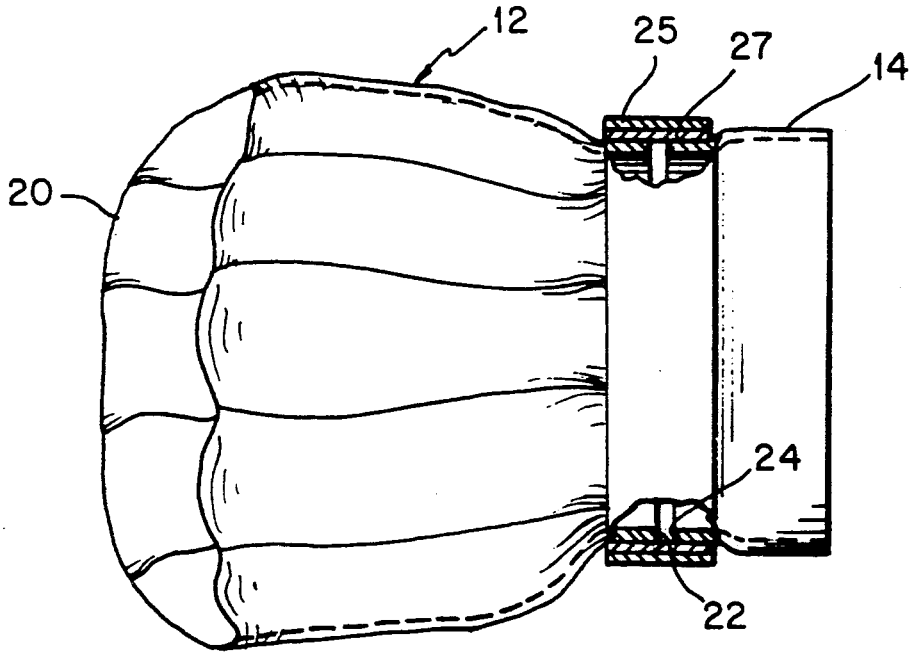
FIG. 4 is a still further embodiment of the garment accessory in the initial, unfolded condition.

Although in the embodiment of FIGS. 1-3, the cuff is directly connected to the gripping portion, it should be understood that these portions could be connected to each other by means of an intermediary member. In FIG. 4, which illustrates such type of garment accessory, the cuff 12 and the gripping portion 14 are connected to an intermediate portion 25 by any suitable attachment means, i.e., a stitched seam, etc. An elastic portion 27 can be attached to an underside area of the intermediary member. It is shown in FIG. 4 that the rear edge 22 of the cuff and the front edge 24 of the gripping portion are connected to the elastic portion 27. The elastic portion facilitates gathering of the material at the rear end of the cuff and simplifies connection between the sleeve-type gripping portion and the funnel-type cuff. The elastic part 27 is especially helpful in manufacturing of the garment accessories having cuffs of ruffled or pleated configuration, since it facilitates the assembly process. Typically, during the assembly of the garment accessory of FIG. 4, the rear end of the cuff 22 is initially gathered and then attached to the inside area of the elastic portion 27. Then, the elastic portion with the cuff are attached to an interior of the intermediary member 25. Finally, the front edge 24 of the gripping portion is connected to the inside area of the elastic part spaced from the edge 22 of the cuff.

The elastic portion also could be used in the garment accessory in which the cuff is directly connected to the gripping portion without any intermediary member. In this construction, after the cuff and elastic portion are attached to each other in the manner shown in FIG. 4, then the exterior of the elastic member is permanently attached to the interior of the gripping portion. However, any suitable way of connection between the cuff, the gripping portion, the elastic part and/or the intermediary member are within the scope of the present invention.

The elastic part enhances flexibility of the garment accessory and enables it to slip over and snugly fit about the forearms and/or wrists of varying sizes.

Figure 5:
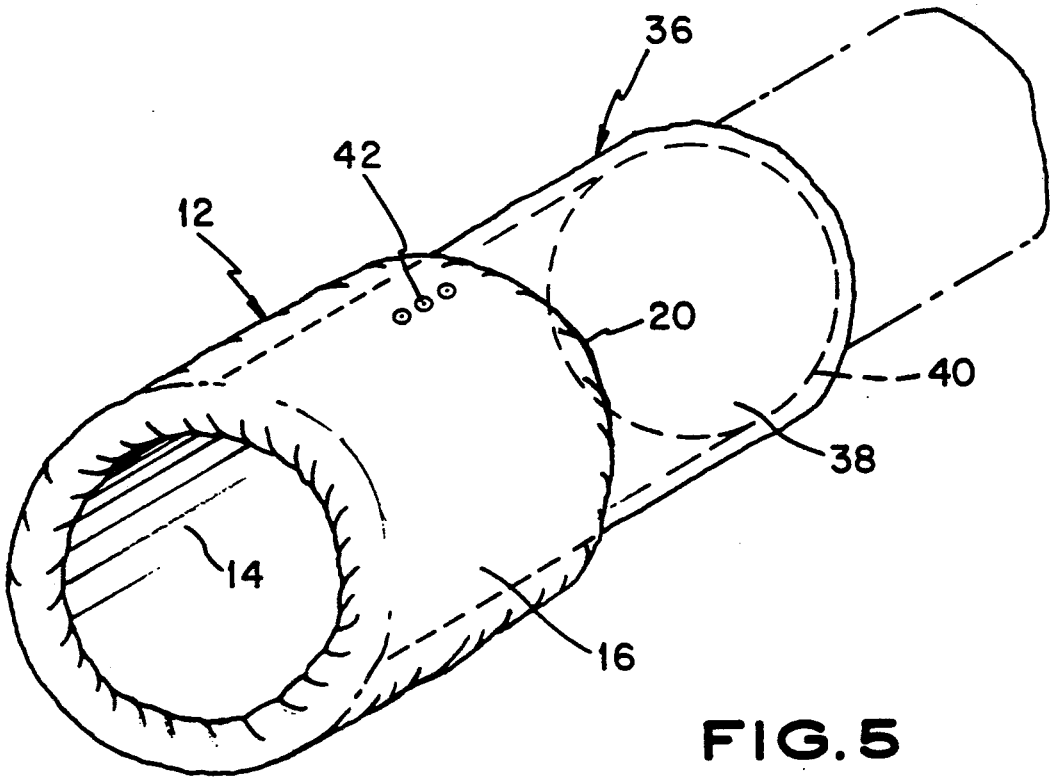
FIG. 5 is a semiperspective view which illustrates the garment accessory in combination with a sleeve of a garment.
Figure 6:
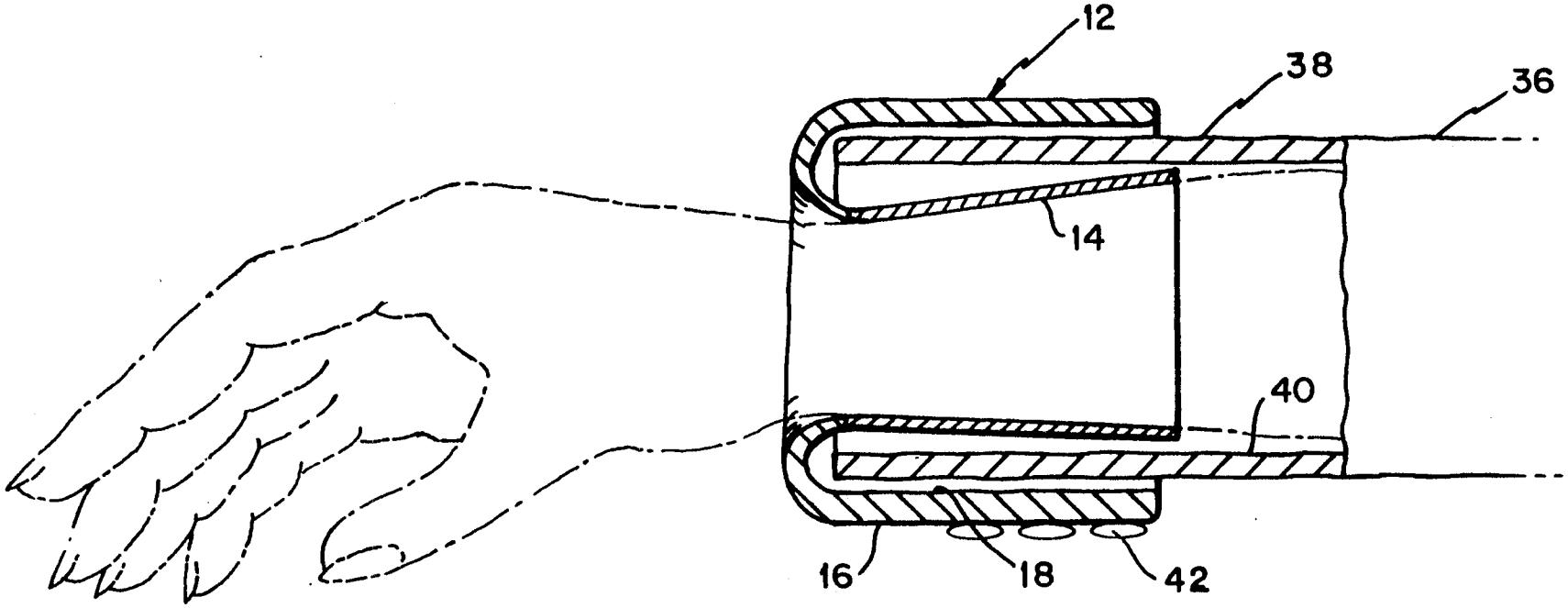
FIG. 6 is a partially cross-sectional view showing a combination of the garment accessory and a sleeve of a garment.

An important ultimate object of the garment accessory shown in FIGS. 1-6, is to be used in combination with sleeves of a garment to create a new decorative effect when the garment and the accessory are worn together. In use, as illustrated in FIGS. 5 and 6, the garment accessory is initially placed on the arm of the user so that the gripping portion engages a forearm in such a manner that the rear edge of the cuff means is situated near the wrist. In this position, the inner surface of the cuff extends along the forearm, wrist and/or hand of the user. The garment accessory is typically used in combination with the garment (not shown) having at least one sleeve 36. The sleeve is defined by an interior part 40 and exterior part 38. When the garment is worn and the garment accessory is in its first initial condition, at least a portion of the inner surface 14 of the cuff 12 faces the hand of a user and at least a portion of the outer surface 18 lies against the interior part 40 of the sleeve of the garment. Then, the cuff 12 is turned over inside out and positioned on the sleeve of the garment in the direction of the elbow. In this manner, the inner surface 16 of the cuff extends outwardly along the sleeve and is exposed to the eyes of an observer to create a novel decorative effect. In the same manner, the outer surface 18 of the cuff faces the exterior portion 38 of the sleeve of the garment.

It is within the scope of the invention to provide any type of decorations 42, such as buttons, etc. on the inner part 16 of the cuff so that when it is turned over, such decorations are facing the eyes of an observer, thus enhancing the decorative effect created by the invention.

Figure 7:
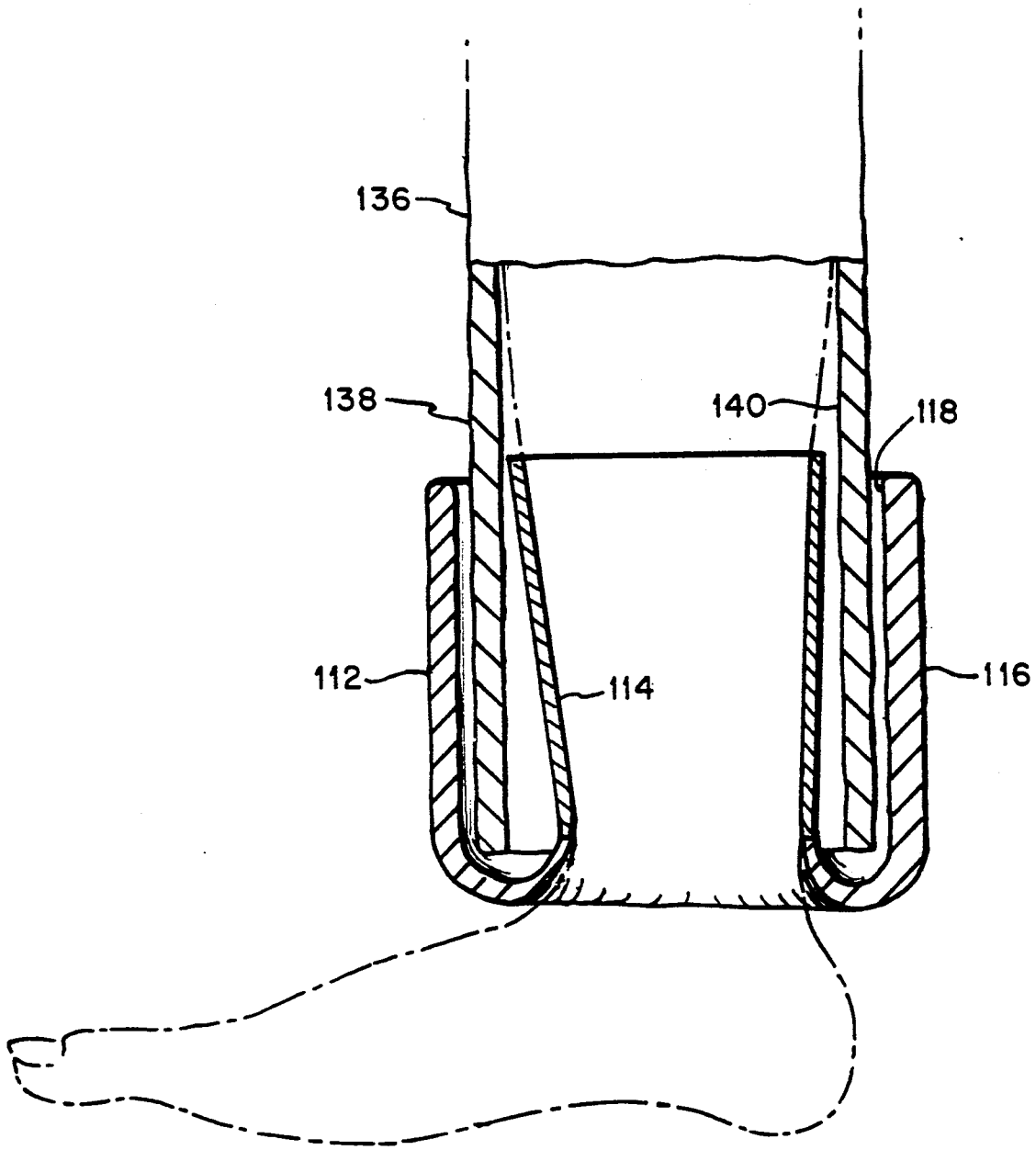
FIG. 7 is a partially cross-sectional view showing a combination of the garment accessory with the leg of the trousers.

An alternative embodiment illustrating application of the concept of the invention to trousers, pants and the like is shown in FIG. 7. In this embodiment, the garment accessory is used in combination with trousers (not shown) having at least one leg 136. The leg consists of an interior part 140 and exterior part 138. Similar to the above discussed embodiments, the garment accessory of FIG. 7 consists of a cuff or cuff means 112 having an inner surface 116 and an outer surface 118 and a gripping portion 114. In use, as shown in FIG. 7, the garment accessory is placed on the calf area between a knee and an ankle of the user, so that the gripping portion engages the calf area in such a manner that the rear edge of the cuff means is situated near the ankle. In such position, the inner surface of the cuff extends along the foot of the user. When the trousers are worn and the garment accessory is in its initial condition, at least a portion of the inner surface 116 of the cuff 112 faces the foot of the user and at least a portion of the outer surface 118 lies against the interior part 140 of the leg of the trousers. Then, the cuff 112 is turned over inside out and positioned on the leg of the trousers in the direction of the knee. In this condition, the inner surface 116 of the cuff extends outwardly along the lower part of the leg of the trousers and is exposed to an observer, thusly, creating an unexpected decorative effect. At that time, the outer surface 118 of the cuff lies against the exterior portion 13 of the leg of the trousers.

Figure 8:
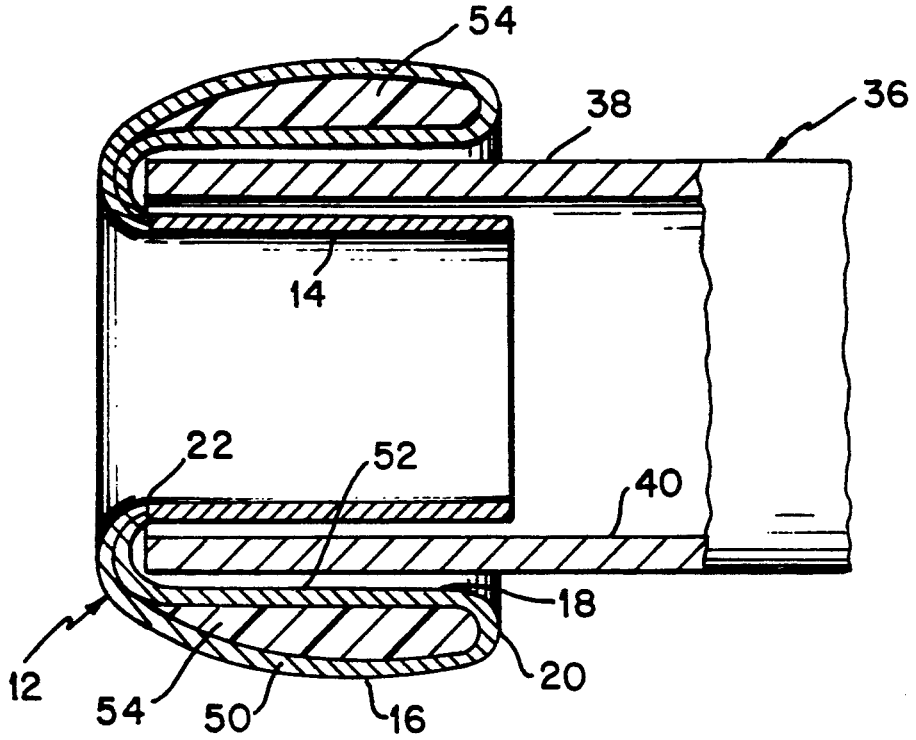
FIG. 8 is a partially cross-sectional view showing a modified embodiment of the cuff.

It was discussed hereinabove that the cuff could be manufactured from two individual layers of fabric. FIG. 8 shows a further embodiment of the present invention in which the cuff consists of a first layer 50 having the inner surface 16 and a second layer 52 having the outer surface 18. An insert 54 having rigidity higher than rigidity of the layers is interposed between the first and the second layer. The insert could extend through the entire length of the cuff, from its front 20 to the rear edge 22, or could be terminated someplace inbetween these two edges as illustrated in FIG. 8. The insert 54 could be manufactured from foam, paper or cardboard, flexible plastic or any type of suitable material. The purpose of the insert is to provide the cuff with a certain degree of rigidity and to enable the cuff 12 to extend linearly without substantial folds along the sleeve means 36 in the second working condition of the garment accessory. The first layer 50 could be attached to the second layer 52 through the insert 54 by securing means, such as stitching. However, means other than stitching, such as adhesives, etc. can also be employed.

When the insert 54 is made of a foam or any material having thickness greater than that of the layers 50 and 52, then, as illustrated in FIG. 8, the inner surface 16 extends substantially outwardly from the outer part 38 of the sleeve means. This creates a bulge type, fluffy appearance of the end portion of the sleeve means.

What is claimed is:

1. A garment accessory for application to an arm of a human being and for use in combination with a garment having at least one sleeve means, said garment accessory comprising cuff means and gripping means, said cuff means having a decorative inner surface and an outer surface, said garment accessory being mounted about said arm and being movable from a first to a second position while mounted about said arm, in said first position said gripping means engages a forearm of the user, so that said cuff means in its unfolded condition is positioned adjacent to a wrist of the user and said decorative inner surface faces a hand of the user, in said second position at least an end portion of said cuff means is turned inside out in such a manner that said decorative inner surface of said cuff means extends over said sleeve means, thereby creating a decorative effect.

2. A garment accessory as claimed in claim 1, wherein said sleeve means of the garment is defined by at least an exterior portion thereof, in said second position of said accessory, said exterior portion of the sleeve means faces said outer surface of said cuff means.

3. A garment accessory as claimed in claim 1, wherein interconnecting means is provided for interconnecting said cuff and gripping means.

4. A garment accessory as claimed in claim 3, wherein said interconnecting means has an elastic part.

5. A garment accessory as claimed in claim 3, wherein said cuff and gripping means are attached to said interconnecting means by stitching.

6. A garment accessory as claimed in claim 1, wherein in said first position, said decorative inner surface of said cuff means faces a hand of the user.

7. A garment accessory as claimed in claim 6, wherein in said first position, said inner surface of the cuff means extends along the hand of the user.

8. A garment accessory as claimed in claim 1, wherein said inner decorative surface is made of one of the following group of fabrics silk, cotton and polyester.

9. A garment accessory for application to a leg of a human being and for use in combination with a garment having at least one leg means, said garment accessory comprising cuff means and gripping means, said cuff means having a decorative inner surface and an outer surface, said garment accessory being mounted about said leg and being movable from a first to a second position while mounted about said leg, in said first position said gripping means engages a calf area of said leg of the user, so that said cuff means in its unfolded condition is positioned adjacent to an ankle of the user and said decorative inner surface faces a foot of the user, in said second position at least an end portion of said cuff means is turned inside out in such a manner that said decorative inner surface of said cuff means extends over said leg means of the garment, thereby creating a decorative effect.

10. A garment accessory as claimed in claim 9, wherein said leg means of the garment is defined by at least an exterior portion thereof, in said second position of said accessory, said exterior portion of the leg means faces said outer surface of said cuff means.

11. A garment accessory as claimed in claim 9, wherein interconnecting means is provided for interconnecting said cuff and gripping means.

12. A garment accessory as claimed in claim 11, wherein said interconnecting means has an elastic part.

13. A garment accessory as claimed in claim 11, wherein said cuff and gripping means are attached to said interconnecting means by stitching.

14. A garment accessory as claimed in claim 11, wherein in said first position, said decorative inner surface of said cuff means faces a leg of the user.

15. A garment accessory as claimed in claim 14, wherein in said first position, said inner surface of the cuff means extends along the leg of the user.

16. A garment accessory as claimed in claim 1, wherein said cuff means further comprises a first layer having said decorative inner surface and a second layer having said outer surface.

17. A garment accessory as claimed in claim 16, wherein an insert having rigidity higher than rigidity of said layers is interposed between said first and said second layers.

18. A garment accessory as claimed in claim 17, wherein said insert extends through the entire length of said cuff means.

19. A garment accessory as claimed in claim 17, wherein said insert is made of one of the following group of materials, foam, paper, and flexible plastic.

20. A garment accessory as claimed in claim 9, wherein said cuff means further comprises a first layer having said decorative inner surface and a second layer having said outer surface, and an insert having rigidity higher than rigidity of said layers is interposed between said first and said second layers.

* * * * *